US011473879B2

(12) United States Patent
Salisbury et al.

(10) Patent No.: US 11,473,879 B2
(45) Date of Patent: Oct. 18, 2022

(54) INNER BORE DETENTS FOR A CARTRIDGE OF A CONDUCTED ELECTRICAL WEAPON

(71) Applicant: Axon Enterprise, Inc., Scottsdale, AZ (US)

(72) Inventors: Luke Salisbury, Scottsdale, AZ (US); Dubravko Zekanovic, Scottsdale, AZ (US); Magne Nerheim, Paradise Valley, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 61 days.

(21) Appl. No.: 17/012,535

(22) Filed: Sep. 4, 2020

(65) Prior Publication Data

US 2021/0071998 A1 Mar. 11, 2021

Related U.S. Application Data

(60) Provisional application No. 62/896,915, filed on Sep. 6, 2019.

(51) Int. Cl.
*F41H 13/00* (2006.01)
*F42B 12/36* (2006.01)

(52) U.S. Cl.
CPC ..... *F41H 13/0025* (2013.01); *F42B 12/36* (2013.01)

(58) Field of Classification Search
CPC ..... F41H 13/0025; F42B 12/36; H05C 1/06
USPC ..... 361/232
See application file for complete search history.

(56) References Cited

U.S. PATENT DOCUMENTS

| | | | | |
|---|---|---|---|---|
| 4,024,819 | A | 5/1977 | Schirneker | |
| 5,400,689 | A | 3/1995 | Hutter et al. | |
| 6,343,553 | B1 | 2/2002 | O'Dwyer | |
| 6,708,683 | B1 * | 3/2004 | Harris | F41B 7/04 124/20.3 |

(Continued)

FOREIGN PATENT DOCUMENTS

| | | | |
|---|---|---|---|
| CN | 108151584 | A | 6/2018 |
| JP | 2000046494 | A | 2/2000 |
| WO | 2018/182768 | A1 | 10/2018 |

OTHER PUBLICATIONS

Taiwan Intellectual Property Office, Office Action for Taiwanese Patent Application No. 109130586 dated Jul. 8, 2021.

(Continued)

*Primary Examiner* — Yemane Mehari
(74) *Attorney, Agent, or Firm* — Justin Powley

(57) ABSTRACT

A CEW includes a handle and one or more cartridges. A cartridge may cooperate with the handle to launch one or more electrodes. Launched electrodes fly toward the target to couple to the target to provide a stimulus signal through the target to impede locomotion of the target. Prior to launch, detents may retain an electrode in a bore of the cartridge. The bore may be sealed with a door. Launching the electrode may remove the door from the cartridge. The door may couple to the electrode. The door may remain coupled to the electrode during flight and impact of the electrode with the target. The door may cushion the impact of the electrode against the target. Cushioning the impact may reduce the likelihood of injuring the target. Retaining the door coupled to the electrode during flight may improve the flight characteristics of the electrode.

20 Claims, 8 Drawing Sheets

(56) References Cited

U.S. PATENT DOCUMENTS

| | | | | |
|---|---|---|---|---|
| 10,288,388 | B1 * | 5/2019 | Lavin | F41H 13/0025 |
| 2019/0257622 | A1 | 8/2019 | Lavin et al. | |

OTHER PUBLICATIONS

International Searching Authority, International Search Report and Written Opinion for International Patent Application No. PCT/US2020/049378 dated Dec. 10, 2020.

* cited by examiner

INNER BORE DETENTS FOR A CARTRIDGE OF A CONDUCTED ELECTRICAL WEAPON

FIELD OF INVENTION

Embodiments of the present invention relate to a conducted electrical weapon ("CEW") (e.g., electronic control device) that launches electrodes to provide a current through a human or animal target to impede locomotion of the target.

BRIEF DESCRIPTION OF THE SEVERAL VIEWS OF THE DRAWING

Embodiments of the present invention will be described with reference to the drawing, wherein like designations denote like elements, and.

DETAILED DESCRIPTION OF INVENTION

Figure 1:
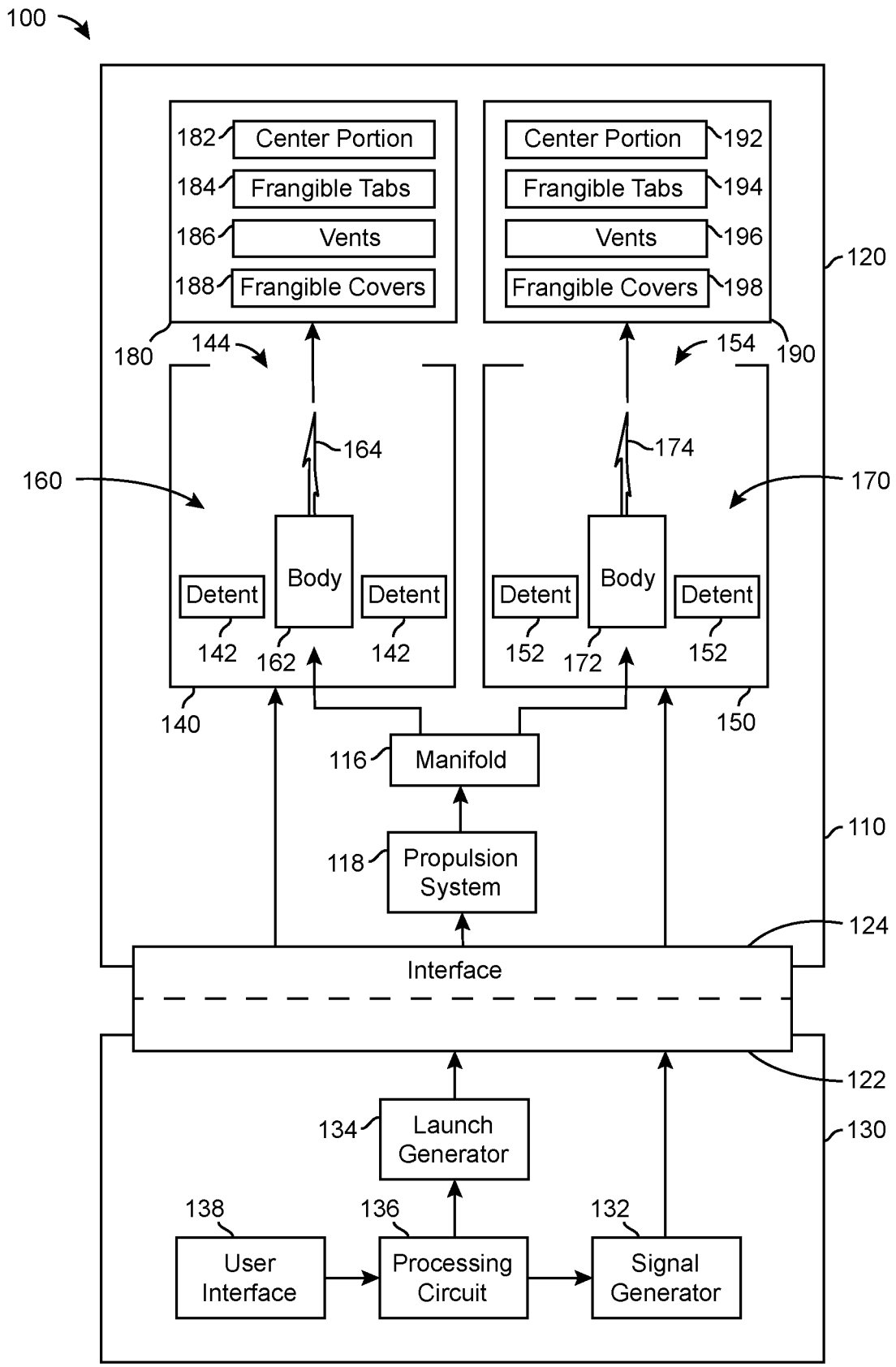
FIG. 1 is a functional diagram of a conducted electrical weapon ("CEW") according to various aspects of the present disclosure.

A conducted electrical weapon ("CEW") provides (e.g., delivers) a stimulus signal (e.g., current, pulses of current, pulses of charge) through tissue of a human or animal target. A stimulus signal provides a charge to target tissue. A stimulus signal may interfere with voluntary locomotion (e.g., walking, running, moving) of the target. A stimulus signal may cause pain in the target. Pain may encourage a target to stop moving. A stimulus signal may cause the skeletal muscles of a target to become stiff (e.g., lock up, freeze). The stiffening of the muscles in response to a stimulus signal may be referred to as neuromuscular incapacitation ("NMI"). NMI disrupts voluntary control of the muscles of the target. The inability of the target to control its muscles interferes with locomotion by the target.

A CEW may include wire-tethered electrodes (e.g., darts, projectiles, etc.) that are launched toward a target to provide a stimulus signal through the target. The wire that tethers the electrode to the CEW may be referred to as a filament. Wire-tethered electrodes may be positioned in a bore (e.g., cavity) of a cartridge (e.g., deployment unit). A bore may include two or more detents on an inner surface of the bore. The two or more detents may contact the electrode to position (e.g., retain, hold) the electrode in the bore. The detents may retain the electrode in the bore prior to launching the electrode from the bore. A cartridge may include one or more electrodes. Each electrode may be positioned in a respective bore. Each electrode is coupled to a respective filament.

A cartridge may be inserted into a handle. A handle coupled to one or more cartridges form a CEW. The one or more cartridges may be removably coupled to the handle. A handle may include a user interface, a processing circuit, a signal generator, and/or a launch generator. An interface on the cartridges inserted into the handle mechanically and electrically couples to an interface on the handle. The signal generator couples to the cartridges via the handle interface and the cartridge interface. A handle may cooperate with one or more cartridges to perform the functions of a CEW. The functions of a CEW include launching one or more electrodes toward a target and/or delivering the stimulus signal through the target. A cartridge may be removed from a handle after launch of the electrodes and/or delivery of the stimulus signal.

A cartridge may include a propulsion system for launching one or more electrodes toward a target. A propulsion system provides a force for launching (e.g., pushing) the one or more electrodes from the cartridge toward the target. A propulsion system may provide any type of force (e.g., mechanical, pyrotechnic) for launching the one or more electrodes.

In an implementation, a propulsion system may include a pyrotechnic (e.g., primer, charge), a canister, an anvil, and a manifold. The canister contains a compressed gas that rapidly expands when the canister is opened (e.g., pierced, punctured, ruptured). The force provided by the rapidly expanding gas launches the one or more electrodes.

The canister may be opened by an anvil to release the gas. An anvil includes a bore and is shaped to pierce the canister. The manifold connects the bore of the anvil to the one or more bores of the cartridge. The launch generator in the handle sends (e.g., transmits) a signal to the cartridge to initiate the propulsion system. Initiation of the propulsion system ignites the pyrotechnic. A rapidly expanding gas from the pyrotechnic applies a force to the canister. The force of the pyrotechnic moves the canister toward and into contact with the anvil. The anvil pierces the canister to release the gas from the canister. The gas from the canister rapidly expands, it enters the bore of the anvil and moves (e.g., expands) through the manifold to enter the one or more bores of the cartridge. The rapidly expanding gas from the canister applies a force to the one or more electrodes positioned in their respective bores of the cartridge. The gas pushes the electrodes from the bores to launch the electrodes toward the target. The gas provides enough force to launch the electrodes so that they fly through the air toward the target. Generally, a CEW launches at least two electrodes to deliver a stimulus signal through a target.

As electrodes fly (e.g., travel) toward the target, their respective wire tethers deploy behind the electrodes. One end of the filament mechanically couples to the cartridge and the other end of the electrode mechanically couples to the electrode. The wire tether spans (e.g., reaches) between the CEW and the electrode at the target to electrically couple the CEW via the electrode to the target. The one or more launched electrodes mechanically and/or electrically couple to tissue of the target.

An electrode may include a spear for piercing target tissue or clothing to mechanically couple the electrode to the target. In an implementation, an electrode launched by the CEW, includes a body and a spear. The body has a substantially cylindrical shape. The spear is mechanically coupled to a forward portion of the body. A wire (e.g., wire, filament) tethers the electrode to the CEW to provide the current through the target. The wire is stored (i.e., stowed) inside the body of the electrode prior to launching the electrode. The wire deploys from the body of the electrode as the electrode flies toward the target. An electrode is typically launched from the CEW at a speed of between 120 feet (36.576 meters) to 150 feet (45.72 meters) per second, although electrodes may also be launched at other speeds.

In an implementation, the body of an electrode is between 0.458 inches (1.163 centimeters) and 0.465 inches (1.181 centimeters) in diameter. An electrode, including the spear and body, is about 1.23 inches (3.124 centimeters) in length. The electrode weighs about 5 grams while the wire is stowed inside the body of the electrode.

Prior to firing, a cartridge is closed (e.g., sealed) to protect the electrodes and other components in the cartridge. The open end of a bore, at the front of a cartridge, may be sealed by a door (e.g., cover). In an unfired cartridge, the electrodes are not visible to a user. The closed environment of the cartridge protects the electrode and other components from damage during storage, transport, and before use. For example, in the event that a cartridge is dropped before use, the cartridge housing protects the electrodes and other components so that the cartridge is not damaged.

In order to launch an electrode from a cartridge, the door that seals the open end of the bore must be open so that the electrode may exit the cartridge. A door may be opened by the force of the rapidly expanding gas. A door may press against a door to open the door. In an implementation, the rapidly expanding gas moves the electrode forward in the bore so that the forward portion of the electrode contacts the door. As a rapidly expanding gas presses on the door, the electrode presses on the door to open the door. Opening the door may include detaching (e.g., breaking, decoupling, etc.) the door from the cartridge.

Due to manufacturing tolerances and variations, the force necessary to open or break a door may vary from one cartridge to the next. Variations in the force needed to open the door may lead to variability in the resulting trajectory of the electrode. Variability in the trajectory results in variability in the accuracy of delivery of the electrode to a target.

Another factor that may affect the accuracy of launch of an electrode includes the position of the door after opening. When a door is opened by removing the door from a cartridge, the door generally moves out of the flight path of the electrode. If the door does not move out of the flight path of the electrodes, collision between the door and the electrode may alter the trajectory of the electrode and decrease accuracy.

Another factor that may affect the accuracy of launch of an electrode from a cartridge includes any interaction between the door after being opened and a wire tether as it is being deployed. If a door strikes (e.g., contacts, collides with) the wire tether of electrode, the interference may affect the accuracy of flight of the electrode.

In an implementation, a door may include a center portion, two or more frangible tabs, two or more vents, and two or more frangible covers. The two or more covers seal (e.g., cover, close) the two or more vents. The two or more tabs couple to the housing of a cartridge.

Prior to launch, an electrode is positioned in a bore of the cartridge. After initiating the propulsion system, a rapidly expanding gas enters a rear portion of the bore. A first portion of the rapidly expanding gas flows around the sides of the electrode to apply a first force on the door. The first force breaks (e.g., ruptures) the covers and permits the first portion of gas to exit via the vents. The remaining portion of the rapidly expanding gas applies a second force on a rear portion of the body of the electrode. The second force moves the electrode forward in the bore. As the electrode moves forward, the electrode detaches from the detents inside the bore. As the electrode continues to move forward in the bore, the spear pierces a center portion of the door. As the electrode continues to move forward, the body contacts the door. As the electrode continues to move forward, contact between the electrode and the door applies a force on the door that breaks the two or more tabs thereby decoupling the door from the cartridge. Because the spear pierced the center portion of the door, the door is mechanically coupled to the spear and to the electrode. As the electrode exits the bore and flies toward the target, the door remains coupled to the electrode. Because the door remains coupled to the electrode after being opened, the door cannot interfere with the electrode or with a filament during deployment, thereby improving accuracy of flight of the electrode.

The momentum of an electrode may injure (e.g., cause damage to) target tissue on impact. A door may decrease the likelihood of injury. As the electrode strikes the target, the door remains coupled to the forward portion of the electrode. The door may absorb (e.g., reduce, cushion, soften, decrease, etc.) some of the force of impact of the electrode with a target thereby reducing potential injury (e.g., bruising, tearing) to tissue and/or skin of the target. A door formed of a pliable (e.g., flexible) material may further reduce the likelihood of injury to a target.

A functional diagram of an implementation of a CEW, according to various aspects of the present invention, is shown in FIG. 1. CEW 100 includes a handle 130 and a cartridge 110. In various embodiments, CEW 100 may include additional cartridges 110. Handle 130, cartridge 110, and CEW 100 may perform the functions of a handle, a cartridge, and a CEW as discussed above.

Handle 130 includes a signal generator 132, a launch generator 134, a processing circuit 136, a user interface 138, and/or an interface 122 (e.g., a first interface, a handle interface, etc.). Handle 130 may mechanically, electrically, and/or electronically couple to cartridge 110. A handle may be shaped for ergonomic use by a user. CEWs may be shaped like a conventional firearm, such as a pistol. A CEW may have any other suitable form factor (e.g., long gun).

Cartridge 110 includes a propulsion system 118, a manifold 116, a housing 120, one or more bores (e.g., a first bore 140, a second bore 150, etc.), one or more doors for each bore (e.g., a first door 180, a second door 190, etc.), one or more electrodes disposed in each bore (e.g., a first electrode 160, a second electrode 170, etc.), and an interface 124 (e.g., a second interface, a cartridge interface, etc.). While cartridge 110 is coupled to handle 130, interface 124 mechanically and electrically couples to interface 122. When cartridge 110 is removed from handle 130, interface 124 decouples from interface 122. Interface 122 remains coupled to handle 130. Interface 124 remains coupled to cartridge 110. When a new cartridge 110 is inserted into handle 130, interface 124 of the new cartridge mechanically and electrically couples to interface 122 of handle 130.

Bore 140 includes one or more detents 142 (e.g., a first detent, a second detent, etc.) and an opening 144. Electrode 160 is positioned and retained in bore 140 a distance from door 180 by detents 142. Electrode 160 includes a body 162 and a spear 164. Door 180 couples to housing 120 and at least partially seals opening 144. Door 180 includes a center portion 182, one or more frangible tabs 184, one or more vents 186, and/or one or more frangible covers 188.

Similarly, bore 150 includes one or more detents 152 (e.g., a first detent, a second detent, etc.) and an opening 154. Electrode 170 is positioned and retained in bore 150 a distance from door 190 by detents 152. Electrode 170 includes a body 172 and a spear 174. Door 190 couples to housing 120 and at least partially seals opening 154. Door 190 includes a center portion 192, one or more frangible tabs 194, one or more vents 196, and/or one or more frangible covers 198.

Propulsion system 118 and manifold 116 cooperate to launch electrodes 160 and 170 toward a target through openings 144 and 154 respectively. Manifold 116 couples (e.g., fluidly couples) propulsion system 118 to bores 140 and 150. A rapidly expanding gas provided by propulsion system 118 travels through manifold 116 to enter the rear portions of bores 140 and 150.

User interface 138 enables (e.g., permits, allows, etc.) a user to initiate (e.g., ignite, activate, etc.) propulsion system 118 to provide the rapidly expanding gas to launch electrodes 160 and 170. User interface 138, processing circuit 136 and launch generator 134 cooperate to launch electrodes 160 and 170. Launch generator 134 transmits a signal through interfaces 122 and 124 to activate propulsion system 118. After activation, propulsion system 118 releases a rapidly expanding gas which moves through manifold 116. Manifold 116 channels (e.g., directs) the rapidly expanding gas to the rear portion of bores 140 and 150.

A portion of the gas that enters bore 140 flows around electrode 160, breaks covers 188 and exits bore 140 via vents 186. The remaining portion of the gas that enters bore 140 applies a force on the rear of electrode 160. The gas moves (e.g., forces, propels, launches, etc.) electrode 160 forward in bore 140 toward opening 144 and door 180. As electrode 160 moves forward, it decouples from detents 142. As electrode 160 continues to move forward, spear 164 contacts and pierces center portion 182 of door 180. As electrode 160 continues to move forward, spear 164 moves forward through center portion 182 of door 180 until a forward portion of body 162 contacts door 180.

As electrode 160 continues to move forward, the forward portion of body 162 contacts door 180. The contact of body 162 with door 180 applies a force to door 180 that ruptures (e.g., breaks) frangible tabs 184. Rupturing frangible tabs 184 decouples door 180 from housing 120 thereby opening door 180 so that electrode 160 may exit bore 140 and fly toward a target. As electrode 160 exits opening 144, door 180 remains impaled on spear 164 so that door 180 is mechanically coupled to the forward portion of body 162. Door 180 is centered on body 162. In various embodiments, door 180 may be slightly larger than the forward portion of body 162, so door 180 covers the forward portion of body 162. In other embodiments, door 180 may be sized and shaped similar to the forward portion of body 162. As electrode 160 flies toward a target, spear 164 retains door 180 coupled to the forward portion of body 162. Spear 164 may include one or more barbs that increase retention of door 180 on the forward portion of body 162.

Similarly, a portion of the gas that enters bore 150 flows around electrode 170, breaks covers 198 and exits bore 150 via vents 196. The remaining portion of the gas that enters bore 150 applies a force on the rear of electrode 170. The gas moves (e.g., forces, propels, launches, etc.) electrode 170 forward in bore 150 toward opening 154 and door 190. As electrode 170 moves forward, it decouples from detents 152. As electrode 170 continues to move forward, spear 174 contacts and pierces center portion 192 of door 190. As electrode 170 continues to move forward, spear 174 moves forward through center portion 192 of door 190 until a forward portion of body 172 contacts door 190.

As electrode 170 continues to move forward, the forward portion of body 172 contacts door 190. The contact of body 172 with door 190 applies a force to door 190 that ruptures (e.g., breaks) frangible tabs 194. Rupturing frangible tabs 194 decouples door 190 from housing 120 thereby opening door 190 so that electrode 170 may exit bore 150 and fly toward a target. As electrode 170 exits opening 154, door 190 remains impaled on spear 174 so that door 190 is mechanically coupled to the forward portion of body 172. Door 190 is centered on body 172. In various embodiments, door 190 may be slightly larger than the forward portion of body 172, so door 190 covers the forward portion of body 172. In other embodiments, door 190 may be sized and shaped similar to the forward portion of body 172. As electrode 170 flies toward a target, spear 174 retains door 190 coupled to the forward portion of body 172. Spear 174 may include one or more barbs that increase retention of door 190 on the forward portion of body 172.

In various embodiments, cartridge 110 may comprise a plurality of propulsion systems. For example, cartridge 110 may comprise a separate propulsion system in communication with each bore in cartridge 110. As a further example, cartridge 110 may comprise a plurality of propulsion systems with each propulsion system in communication with one or more different bores in cartridge 110. Although described herein as a propulsion system releasing a rapidly expanding gas to each bore via a manifold, in other embodiments propulsion system 118 may be configured to provide any other desired or suitable force configured to deploy (or cause deployment of) one or more electrodes.

In various embodiments, processing circuit 136 may comprise any circuitry, electrical components, electronic components, software, and/or the like configured to perform various operations and functions discussed herein. For example, processing circuit 136 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 136 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 136 may include data buses, output ports, input ports, timers, memory, arithmetic units, and/or the like.

Processing circuit 136 may be configured to provide and/or receive electrical signals whether digital and/or analog in form. Processing circuit 136 may provide and/or receive digital information via a data bus using any protocol. Processing circuit 136 may receive information, manipulate the received information, and provide the manipulated information. Processing circuit 136 may store information and retrieve stored information. Information received, stored, and/or manipulated by processing circuit 136 may be used to perform a function, control a function, and/or to perform an operation or execute a stored program.

Processing circuit 136 may control the operation and/or function of other circuits and/or components of handle 130 and/or CEW 100. Processing circuit 136 may receive status information regarding the operation of other components, perform calculations with respect to the status information, and provide commands (e.g., instructions) to one or more other components. Processing circuit 136 may command another component to start operation, continue operation, alter operation, suspend operation, cease operation, or the like. Commands and/or status may be communicated between processing circuit 136 and other circuits and/or components via any type of bus (e.g., SPI bus) including any type of data/address bus.

In various embodiments, processing circuit 136 may be mechanically and/or electronically coupled to a trigger of handle 130. Processing circuit 136 may be configured to detect an activation, actuation, depression, input, etc. (collectively, an "activation event") of the trigger. In response to detecting the activation event, processing circuit 136 may be configured to perform various operations and/or functions, as discussed further herein. Processing circuit 136 may also include a sensor (e.g., a trigger sensor) attached to the trigger and configured to detect an activation event of the trigger. The sensor may comprise any suitable sensor, such as a mechanical and/or electronic sensor capable of detecting an activation event in the trigger and reporting the activation event to processing circuit 136.

Processing circuit 136 may be in electrical and/or electronic communication with user interface 138, launch generator 134, and/or signal generator 132.

Signal generator 132 may be configured to provide a signal (e.g., stimulus signal). A signal may include a current. A signal may include a pulse of current. A signal may include a series of (e.g., two or more) current pulses. The signal provided by signal generator 132 may electrically couple a CEW to a target by ionization of air between an electrode of the CEW and the target. Signal generator 132 may provide a signal at a voltage of sufficient magnitude to ionize air in one or more gaps in series with signal generator 132 and a target to establish one or more ionization paths to sustain delivery of a current through the target. The signal provided by signal generator 132 may provide a current through target tissue to interfere with (e.g., impede) locomotion of the target. Signal generator 132 may provide a signal at a voltage to impede locomotion of a target by inducing fear, pain, and/or an inability to voluntary control skeletal muscles (e.g., NMI) as discussed above.

A stimulus signal, as discussed above, may include one or more pulses of current. A pulse of current may be provided at one or more magnitudes of voltage and/or a combination of different voltage magnitudes. A pulse of current may accomplish electrical coupling and impeding locomotion as discussed above. A current pulse of a stimulus signal may include a high voltage portion for ionizing gaps of air to establish electrical coupling and a lower voltage portion for providing a current through target tissue to impede locomotion of the target. A portion of the current used to ionize gaps of air to establish electrical connectivity may also contribute to the current provide through target tissue to impede locomotion of the target.

Pulses of the stimulus signal may be delivered at a pulse rate (e.g., 22 pps) for a period of time (e.g., 5 second). One or more stimulus signals, or in other words one or more series of pulses, may be applied to a target to impede locomotion by the target. Each pulse of a stimulus signal may be capable of establishing electrical connectivity (e.g., ionizing air in one or more gaps) and interfering with locomotion of the target by passing through a circuit that includes target tissue.

Signal generator 132 may include circuits for receiving electrical energy and for providing the stimulus signal. Electrical/electronic circuits (e.g., components) of signal generator 132 may include capacitors, resistors, inductors, spark gaps, transformers, silicon controlled rectifiers ("SCRs"), and analog-to-digital converters. Processing circuit 136 may cooperate with and/or control the circuits of signal generator 132 to produce a stimulus signal. Signal generator 132 may be electrically and/or electronically coupled to processing circuit 136 and/or interface 122.

Signal generator 132 may receive electrical energy from a power supply. Signal generator 132 may convert the energy from one form of energy into a stimulus signal for ionizing gaps of air and interfering with locomotion of a target. Processing circuit 136 may cooperate with and/or control a power supply in its provision of energy to signal generator 132. Processing circuit 136 may cooperate with and/or control signal generator 132 in converting the received electrical energy into a stimulus signal.

Launch generator 134 may be configured to provide a signal (e.g., launch signal). Launch generator 134 may be configured to receive one or more control from processing circuit 136. Launch generator 134 may provide an ignition signal to cartridge 110 based on the control signals. Launch generator 134 may be electrically and/or electronically coupled to processing circuit 136 and/or interface 122. Launch generator 134 may also be electrically coupled to a power supple and may use power received from the power supply to generate an ignition signal. Launch generator 134 may temporarily store power from the power supply and rely on the stored power entirely or in part to provide the ignition signal. Launch generator 134 may also rely on received power from the power supply entirely or in part to provide the ignition signal, without needing to temporarily store power.

Launch generator 134 may be controlled entirely or in part by processing circuit 136. In various embodiments, launch generator 134 and processing circuit 136 may be separate components (e.g., physically distinct and/or logically discrete). Launch generator 134 and processing circuit 136 may be a single component. For example, a control circuit within housing handle 130 may at least include Launch generator 134 and processing circuit 136. The control circuit may also include other components and/or arrangements, including those that further integrate corresponding function of these elements into a single component or circuit, as well as those that further separate certain functions into separate components or circuits.

In various embodiments, launch generator 134 and signal generator 132 may be separate components (e.g., physically distinct and/or logically discrete). Launch generator 134 and signal generator 132 may be a single component. For example, launch generator 134 and signal generator 132 may comprise a single component configured to provide both launch signals and stimulus signals.

User interface 138 may include one or more controls that permit a user to interact and/or communicate with a CEW. Via user interface 138, a user may control (e.g., influence) the operation (e.g., function) of a CEW. User interface 138 may include any suitable device for operation by a user to control the operation of a CEW. User interface 138 may include controls. A control includes any electromechanical device suitable for manual manipulation (e.g., operation) by a user. A control includes any electromechanical device for operation by a user to establish or break an electrical circuit. A control may include a portion of a touch screen. A control may include a switch. A switch may include a pushbutton switch, a rocker switch, a key switch, a detect switch, a rotary switch, a slide switch, a snap action switch, a tactile switch, a thumbwheel switch, a push wheel switch, a toggle switch, and a key lock switch (e.g., switch lock). Operation of a control may occur by the selection of a portion of a touch screen.

Operation of a control may provide information to a CEW. Operation of a control of user interface 138 may result in performance of a function, halting performance of a function, resuming performance of a function, and/or suspending performance of a function of the CEW.

Processing circuit 136 may detect the operation of a control of user interface 138. Processing circuit 136 may perform a function of the CEW responsive to detecting operation of a control. Processing circuit 136 may perform a function, halt a function, resume a function, and/or suspend a function of the CEW responsive to operation of one or more controls. A control may provide analog and/or binary information to processing circuit 136. Operation of a control includes operating an electromechanical device or selecting a portion of a touch screen.

User interface 138 may provide information to a user. A user may receive visual and/or audible information from user interface 138. A user may receive visual information via devices that visually display (e.g., present, show) information (e.g., LCDs, LEDs, light sources, graphical and/or textual display, display, monitor, touchscreen). User interface 138 may include a communication circuit for transmitting information to an electronic device (e.g., smart phone, tablet) for presentation to a user.

For example, user interface 138 may include a trigger, a safety, and/or a display. A safety, when switch to an on position, may inhibit operation of CEW 100. A safety, when switch to an off position, may enable operation of CEW 100. When the safety is positioned in the off position as a trigger is operated, CEW 100 may launch electrodes and provide a stimulus signal through a target. A display may provide status information of the operation of CEW 100 to a user.

In various embodiments, one or more components of CEW 100, handle 130, and/or cartridge 110 may be in electrical communication with a power supply. The power supply may provide power to the one or more components of CEW 100, handle 130, and/or cartridge 110. The power supply may be located within handle 130. The power supply may provide energy for operating the electronic and/or electrical components (e.g., parts, subsystems, circuits, etc.) of CEW 100, handle 130, and/or cartridge 110. The power supply may be electrically coupled to processing circuit 136, user interface 138, launch generator 134, and/or signal generator 132. The power supply may provide electrical power. Providing electrical power may include providing a current at a voltage. Electrical power from the power supply may be provided as a direct current ("DC"). Electrical power from the power supply may be provided as an alternating current ("AC"). The power supply may include a battery. The energy of the power supply may be renewable or exhaustible, and/or replaceable. For example, the power supply may comprise one or more rechargeable or disposable batteries. In various embodiments, the energy from the power supply may be converted from one form (e.g., electrical, magnetic, thermal) to another form to perform the functions of a system. The power supply may provide energy for performing the functions of CEW 100. For example, the power supply may provide the electrical current to signal generator 132 that is provided through a target to impede locomotion of the target The power supply may provide the energy for a stimulus signal. The power supply may provide the energy for other signals, including an ignition signal.

Housing 120 of cartridge 110 provides structure for mounting (e.g., holding, containing housing, etc.) components (e.g., propulsion system, filament, electrode, door, cap, etc.) of cartridge 110. Housing 120 may establish an outer shape of cartridge 110. Housing 120 may include structures (e.g., interfaces, levers, tabs) for coupling cartridge 110 to handle 130. Housing 120 may be formed of a rigid material for establishing the shape and structure of cartridge 110. Housing 120 may include materials that are pliable (e.g., flexible). Housing 120 may protect the components of cartridge 110 during storage, transport, and/or use. Housing 120 may protect the components of cartridge 110 from damage as a result of a shock (e.g., dropping cartridge) 110 and/or external elements.

A housing may include one or more bores (e.g., tubes, cavities). An opening (e.g., aperture) of a bore may be positioned on a forward (e.g., front) portion of the housing. A bore may include two or more detents for retaining an electrode in the bore. The two or more detents retain the electrode, and in particular the tip of the spear of the electrode, away from the opening of the bore prior to launch. A housing may include structures (e.g., manifolds, ducts, tubes) for channeling (e.g., directing) a force of a propulsion system against an electrode in a bore to launch the electrode. A rear portion of a bore may connect (e.g., couple) to a manifold for receiving the force provided by a propulsion system for launching the electrode from the bore. Travel by an electrode along a bore during launch may establish an initial trajectory of the electrode.

A door may couple to a housing to cover the openings of the one or more bores. A door may protect the electrodes during storage, transport, and/or use prior to firing. A door may prevent movement of an electrode from a bore until a magnitude of the force from the propulsion system reaches a minimum amount. A door may be frangible in one or more portions (e.g., surface areas, sections). A frangible portion of the door may be manufactured for repeatable (e.g., predictable, consistent) rupture over many different cartridges and normal manufacturing variations. The physical characteristics of a frangible portion that ruptures may include the type of material that forms the frangible portion, thickness of material at the point most likely to rupture, physical dimensions of the frangible portion, physical dimensions of the door, the shape of the frangible portion, and/or proximity of the frangible portion to the housing. One or more portions of a door may be frangible at a different magnitude of force than other portions of the door.

For example, tabs 184, 194 and covers 188, 198 may break when different magnitudes of force are applied. The frangible portions of the door may break away (e.g., decouple) from the housing when the cartridge is fired to permit an electrode to exit a bore during launch.

A housing may be shaped for inserting, at least partially, into a bay of a handle. A housing may include structures (e.g., levers) for interfering with one or more inner surfaces of the bay for retaining (e.g., holding) the cartridge in the bay. The structures of the housing that interfere with the one or more surfaces of the bay may be moved by a user to a position where they no longer interfere with the bay so that the cartridge may be removed from the bay.

For example, housing 120 includes bore 140 which retains electrode 160 using detents 142, and bore 150 which retains electrode 170 using detents 152. After propulsion system 118 is activated, manifold 116 channels a force from propulsion system 118 through bore 140 and/or bore 150 to launch electrode 160 and/or electrode 170.

A housing may include an interface that comes into physical contact with an interface of the handle while the cartridge is inserted into a bay. Physical contact of the interface on the housing and the interface on the handle establishes an electrical connection between the handle and the cartridge. Removing the housing from the bay separates the interface on the housing from the interface on the handle thereby terminating physical and electrical coupling between the cartridge and handle. An interface may be used to provide electrical communication, unidirectional and/or bidirectional, between a handle and a cartridge. An interface may be used to provide power, data, addresses, control signals, and/or a stimulus signal between the handle and cartridge.

For example, interface 122 of handle 130 and interface 124 of cartridge 110 perform the functions of an interface discussed above.

A filament (e.g., tether, wire, wire-tether) conducts a current. A filament may be formed of a conductor (e.g., wire) that is insulated or uninsulated. A filament electrically couples a signal generator to an electrode. A filament may electrically couple to a signal generator via a circuit that includes an interface of the cartridge and an interface of the handle. A filament carries a current at a voltage for ionizing air in one or more gaps and/or impeding locomotion of a target. A first end of a filament mechanically couples to an electrode. A second end of a filament mechanically couples to a cartridge. The signal generator provides a pulse of a stimulus signal to the electrode via the filament. A filament deploys from an electrode as the electrode flies toward a target.

An electrode (e.g., dart), as discussed above, couples to one end of a filament. An electrode is launched toward a target to deliver a current through the target. An electrode may include aerodynamic structures to improve an accuracy of flight of the electrode toward the target. An electrode may include structures (e.g., body, spear, barbs) for mechanically coupling to a target and/or a door. Movement of an electrode out of a cartridge toward a target applies a force (e.g., pull) on a filament to deploy the filament from the electrode. Once deployed, the filament extends from the cartridge to the electrode at the target. An electrode may be formed in whole or part of a conductive material for delivering the current of the stimulus signal into target tissue.

Propulsion system 118 provides a force to propel one or more electrodes from cartridge 110 toward a target. Propulsion system 118 performs the functions of a propulsion system discussed above. Propulsion system 118 applies a force on a surface (e.g., rear) of electrodes 160 and 170. The force pushes electrodes 160 and 170 from cartridge 110 toward the target. Propulsion system 118 provides the force that opens doors 180 and 190 of bores 140 and 150 to permit exit of electrodes 160 and 170 from cartridge 110. The force from propulsion system 118 is sufficient to open doors 180 and 190 (e.g., by breaking tabs 184 and 194), launch electrodes 160 and 170 at a velocity suitable for traversing a distance to a target, and couple, if possible, electrodes 160 and 170 to a target.

Propulsion system 118 may be initiated (e.g., activated) by an electrical signal (e.g., received from launch generator 134). Propulsion system 118 may be activated mechanically (e.g., firing pin). An electrical signal that activates propulsion system 118 may be provided under the control of processing circuit 136. Movement of a mechanical structure to mechanically activate a propulsion system may be under the control of processing circuit 136. Processing circuit 136 of handle 130 may control and/or provide a signal used to activate propulsion system 118 in cartridge 110. Processing circuit 136 may activate propulsion system 118 responsive to an action (e.g., operation, trigger pull) of a control taken by a user of CEW 100.

Figure 2:
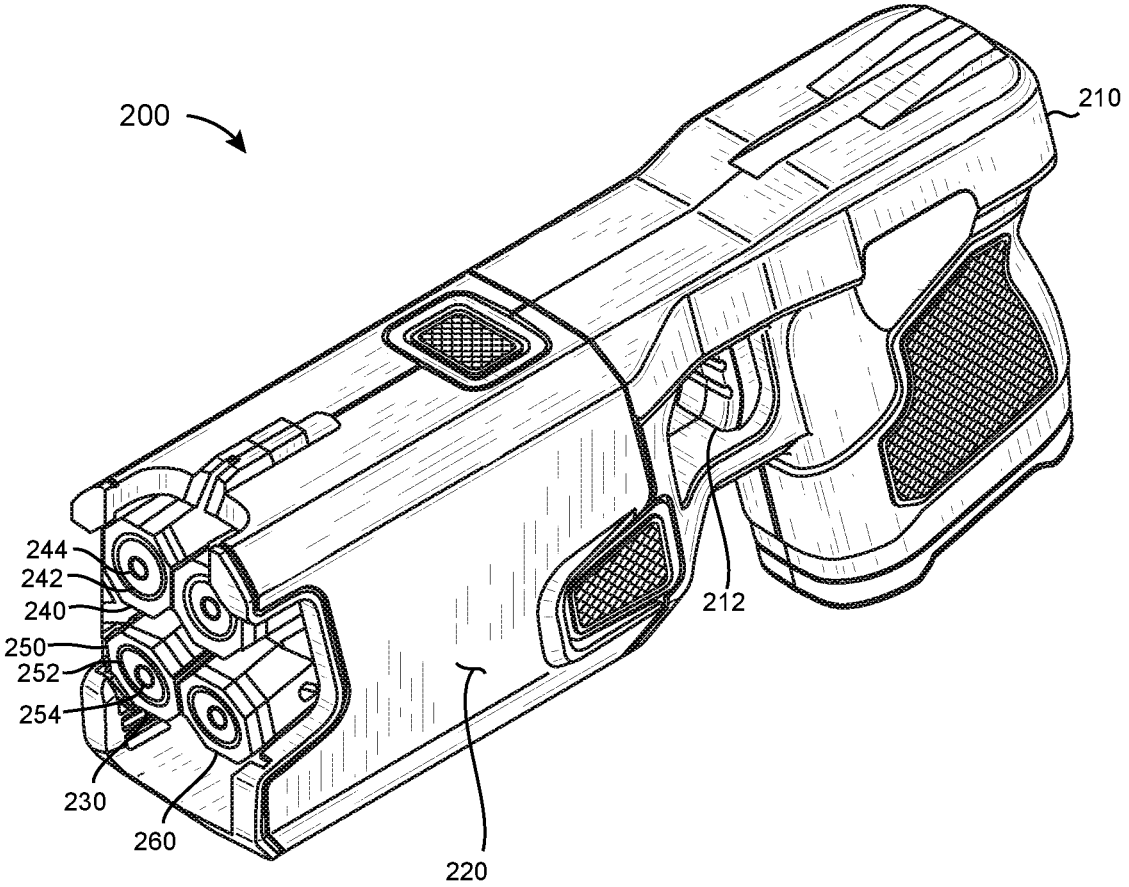
FIG. 2 is a perspective view of an implementation of the CEW of FIG. 1.

In various embodiments, and with reference to FIG. 2, a CEW 200 is disclosed. CEW 200 may be an implementation of CEW 100. CEW 200 performs the functions and includes the structures of a CEW as discussed above. CEW 200 includes a handle 210 and one or more cartridges such as cartridges 230 and 260. Handle 210 may be similar to any handle discussed herein. Cartridges 230, 260 may be similar to any cartridge discussed herein.

Handle 210 includes a trigger 212 (e.g., user interface) and a bay 220. Cartridges 230 and 260 are inserted into bay 220 to form CEW 200. Cartridges 230 and 260 perform the functions of a cartridge discussed above. Cartridge 230 includes one or more caps, such as caps 240 and 250. Cartridge 230 includes one or more doors, such as doors 242, 252. Door 242 includes a center portion 244 and couples (e.g., seals, bonds) to cap 240. Similarly, door 252 includes a center portion 254 and couples to cap 250. Cartridge 260 includes two caps of identical structure to caps 240 and 250. Cartridge 260 may also include two doors of identical structure to doors 242 and 252. To simplify the drawing, the caps and doors of cartridge 260 are not numbered in FIG. 2. Caps 240 and 250 couple to the housing of cartridge 230. Doors 242 and 252 perform the functions of a door as discussed above.

Figure 3:
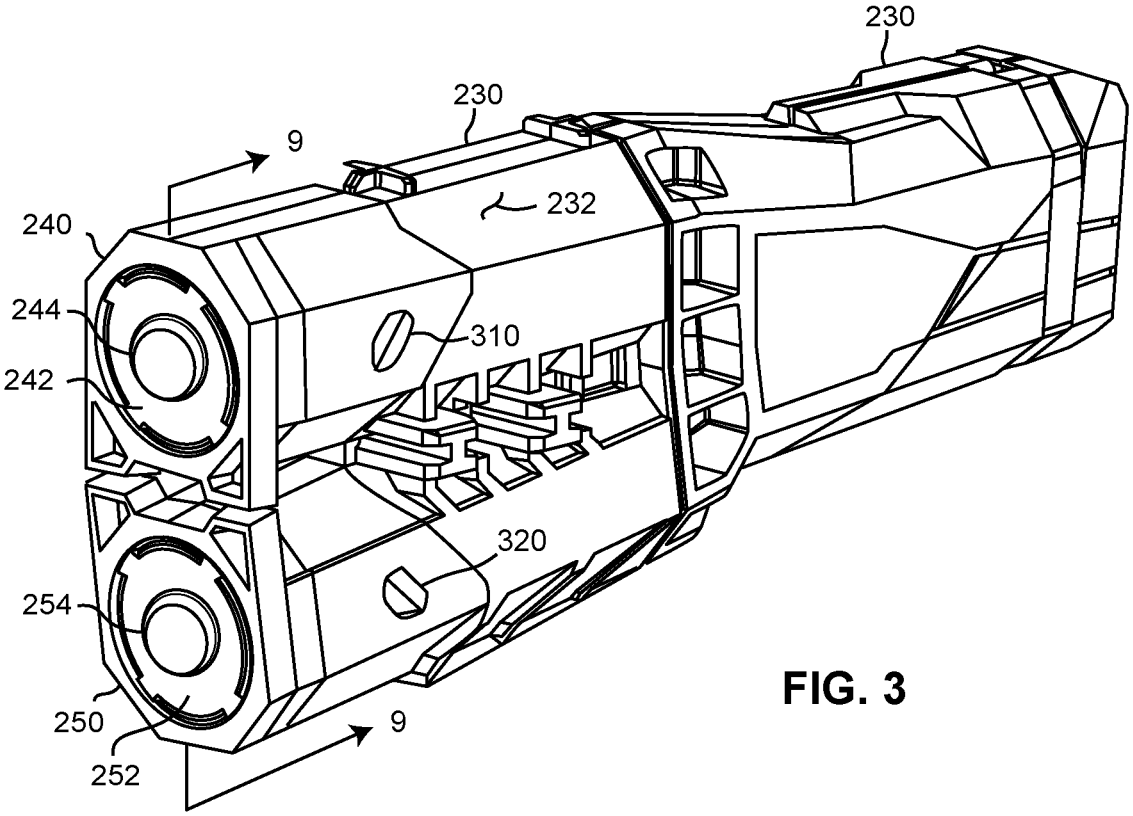
FIG. 3 is a perspective view of a cartridge of the CEW of FIG. 2.

Cartridge 230 is shown removed from bay 220 in FIG. 3. As discussed above, cartridge 230 includes caps 240 and 250. Cap 240 includes a hole (e.g., opening) 310. An additional hole may be positioned on the opposite side of cap 240. Cap 250 includes a hole (e.g., opening) 320 and may also include an additional hole on the opposite side of cap 250. A housing 232 (e.g., cartridge housing) of cartridge 230 includes protrusions that interfere with the edges of holes 310, 320, and the holes on the opposite sides, to retain caps 240 and 250 coupled to housing 232. Caps 240 and 250 may be removably coupled to housing 232. Doors 242 and 252 couple to caps 240 and 250 respectively. Doors 242 and 252 may be formed of a material (e.g., rubber, neoprene, plastic) that couples to caps 240 and 250 respectively by over molding. Caps 240 and 250 cooperate with doors 242 and 250 to at least partially seal cartridge 230 prior to launching electrodes. Doors 242 and 252 may hermetically seal caps 240 and 250. A cross-section view of cartridge 230 along the plane indicated by line 9-9 is provided in FIG. 9.

Figure 4:
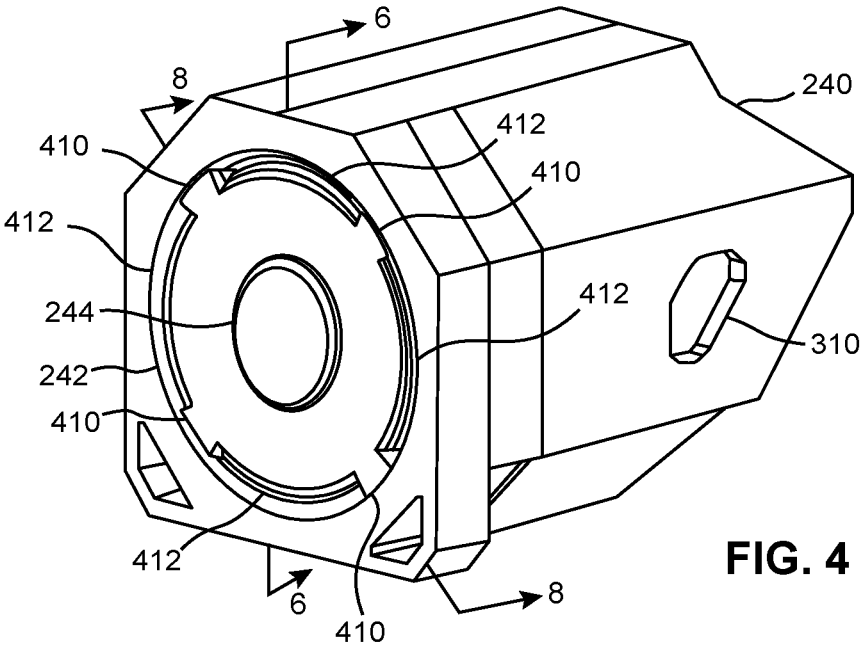
FIG. 4 is a perspective view of a cap of the cartridge of FIG. 3.

The structure of cap 240, according to various aspects of the present invention, is shown in FIGS. 4-8. Cap 250 is identical to cap 240 and does not include numerical identifiers to simplify the drawing. Referring to FIG. 4, cap 240 includes hole 310 and door 242. Door 242 includes center portion 244, one or more tabs 410, and one or more vents 412. As described above, tabs 410 are frangible and are manufactured to break during the launch of an electrode from cartridge 230. Vents 412 may also be frangible in part. Vents 412 vent (e.g., release, expel) a portion of the gas provided by the propulsion system during the launch of an electrode. A cross-section view of cap 240 along the plane indicated by line 6-6 is provided in FIG. 6. A cross-section view of cap 240 along the plane indicated by line 8-8 is provided in FIG. 8.

Figure 5:
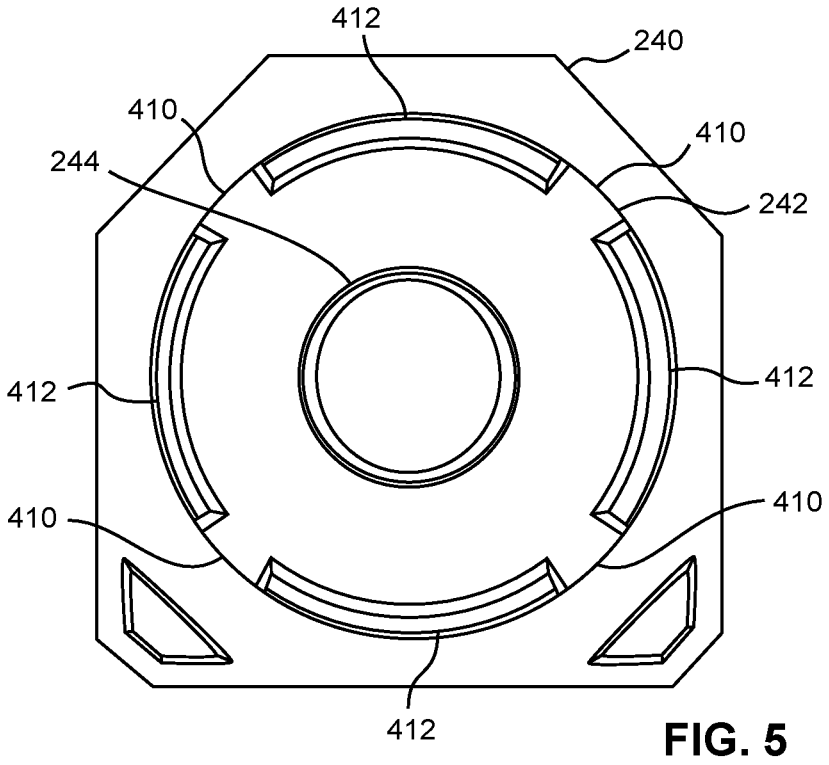
FIG. 5 is a front view of the cap of FIG. 3.

A front view of cap 240, shown in FIG. 5, depicts in greater detail how tabs 410 and vents 412 are distributed around the circumference (e.g., periphery, perimeter) of door 242. Door 242 may include two or more tabs 410 and/or one or more vents 412. The two or more tabs may be distributed in any manner about the perimeter of door 242. Similarly, the one or more vents 412 may be positioned and/or distributed in any manner about the perimeter of door 242. In the implementation shown in FIG. 5, tabs 410 and vents 412 are evenly distributed around the periphery of door 242. An even distribution of tabs 410 around the periphery of door 242 may improve the consistency with which door 452 may be removed by an electrode exiting from cartridge 230. A variability in the force required to decouple (e.g., break) tabs 410 from housing 232 may affect the accuracy of launch and flight of an electrode from cartridge 230. Similarly, an even distribution of vents 412 may decrease the variability of a force required to break the covers of vents 412. Reducing variability in the reaction of structures to the force applied during launch increases the accuracy of launch and flight of an electrode.

Figure 6:
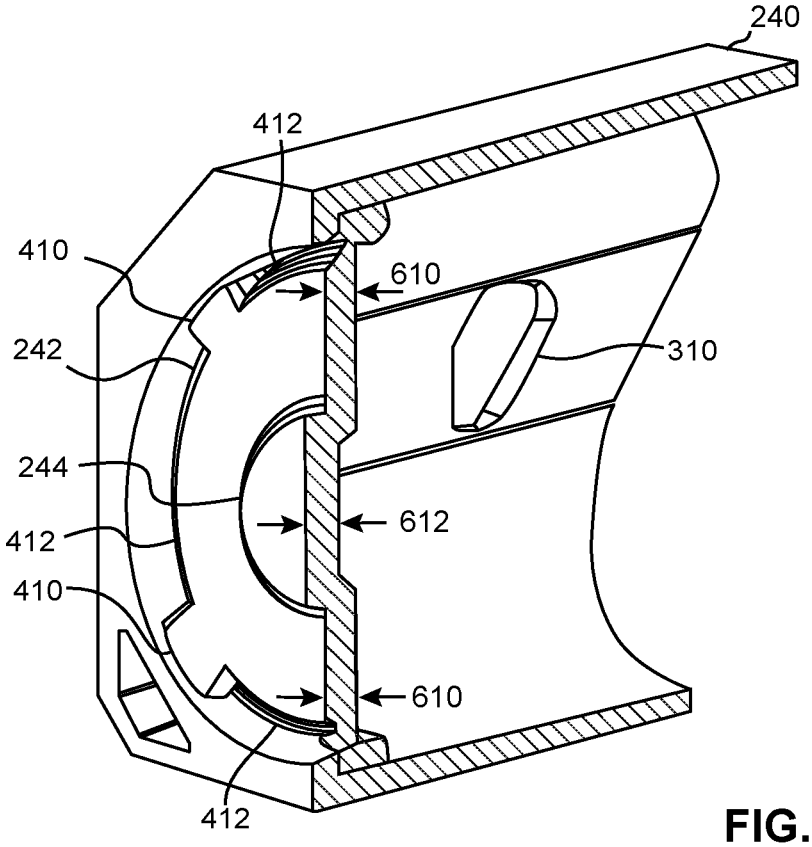
FIG. 6 is a cross-section view of the cap of FIG. 3 along line 6-6 of FIG. 4.
Figure 7:
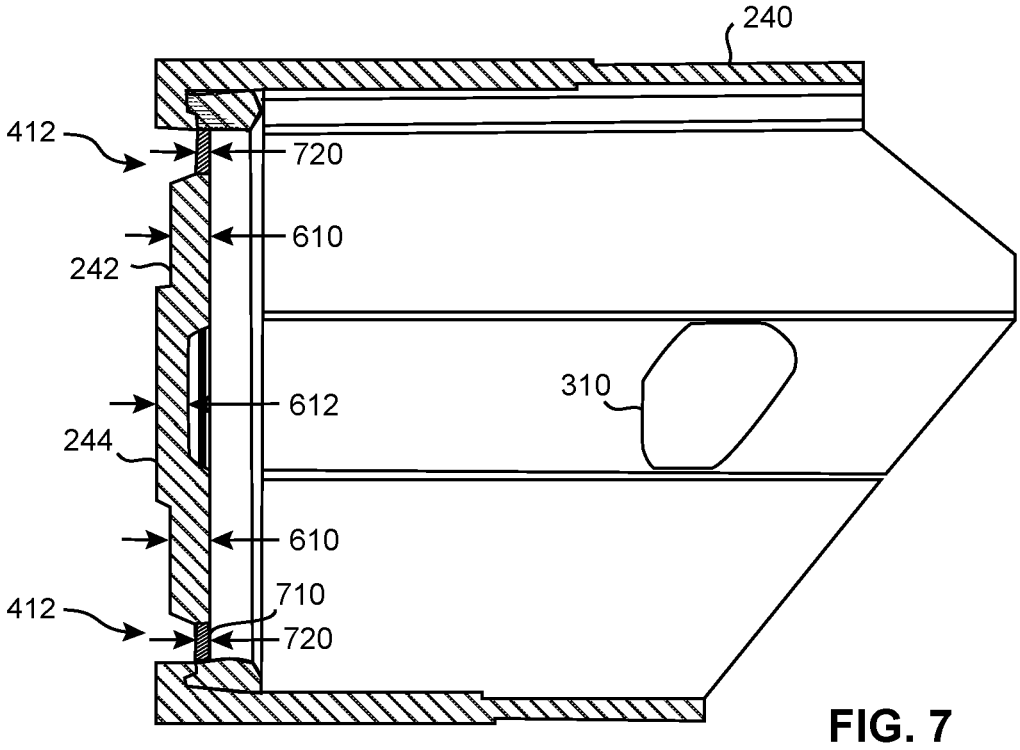
FIG. 7 is a cross-section view of FIG. 6 rotated into the page to provide a side cross-section view.
Figure 8:
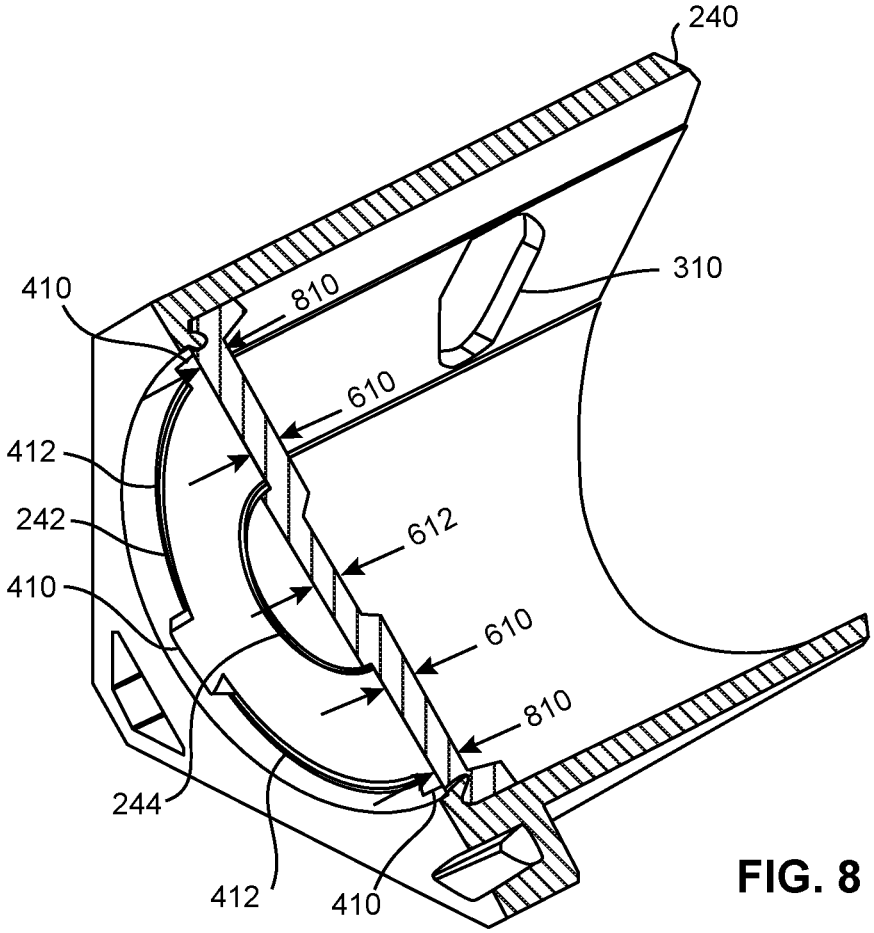
FIG. 8 is a cross-section view of the cap of FIG. 3 along line 8-8 of FIG. 4.

Different portions of door 242 may have different thicknesses, as shown in FIGS. 6-8. For example, a main portion of door 242, other than tabs 410, vents 412, and center portion 444, has a thickness 610 (e.g., a main portion door thickness). Center portion 244 has a thickness 612 (e.g., a center portion thickness). Thickness 612 may be the same thickness as thickness 610, but offset from the plane of the main portion of door 242. Thickness 612 may be greater than thickness 610. A rear portion of center portion 244 may lie in the same plane as the main portion of door 242. The thickness of a frangible portion of door 242 may determine in part the force required to break (e.g., rupture, pierce) that portion of the door.

Prior to launch, vents 412 are covered (e.g., sealed, closed) by one or more covers 710. Covers 710 have a thickness 720 (e.g., a cover thickness). Covers 710 may be frangible. Prior to launching an electrode, covers 710 seal vents 412 so that no gas can pass through vent 412. During launch of an electrode, the force from the propulsion system breaks (e.g., ruptured) covers 710. Breaking covers 710 enables a portion of the gas provided by the propulsion system to exit cartridge 230 via vents 412. Thickness 720 of covers 710 may be less in magnitude than thicknesses 810 of tabs 410, so the magnitude of the force required to break covers 710 may be less than the magnitude of force required to break tabs 410.

As discussed briefly above, tabs 410 have a thickness 810 (e.g., a tab thickness). Thickness 810 may be of equal magnitude to thicknesses 610 and/or 612. Thickness 810 may determine in part the frangibility of tabs 410. As described above, tabs 410 may be broken during launch by the force of the body of the electrode being pressed against door 242. In this implementation, the thickness of all tabs 410 are shown to be the same thickness. Tabs 410 may have different thicknesses (e.g., a variable tab thickness). The thickness of tabs 410 may be related to the relative position to each other and to their distribution around the periphery of door 242.

Figure 9:
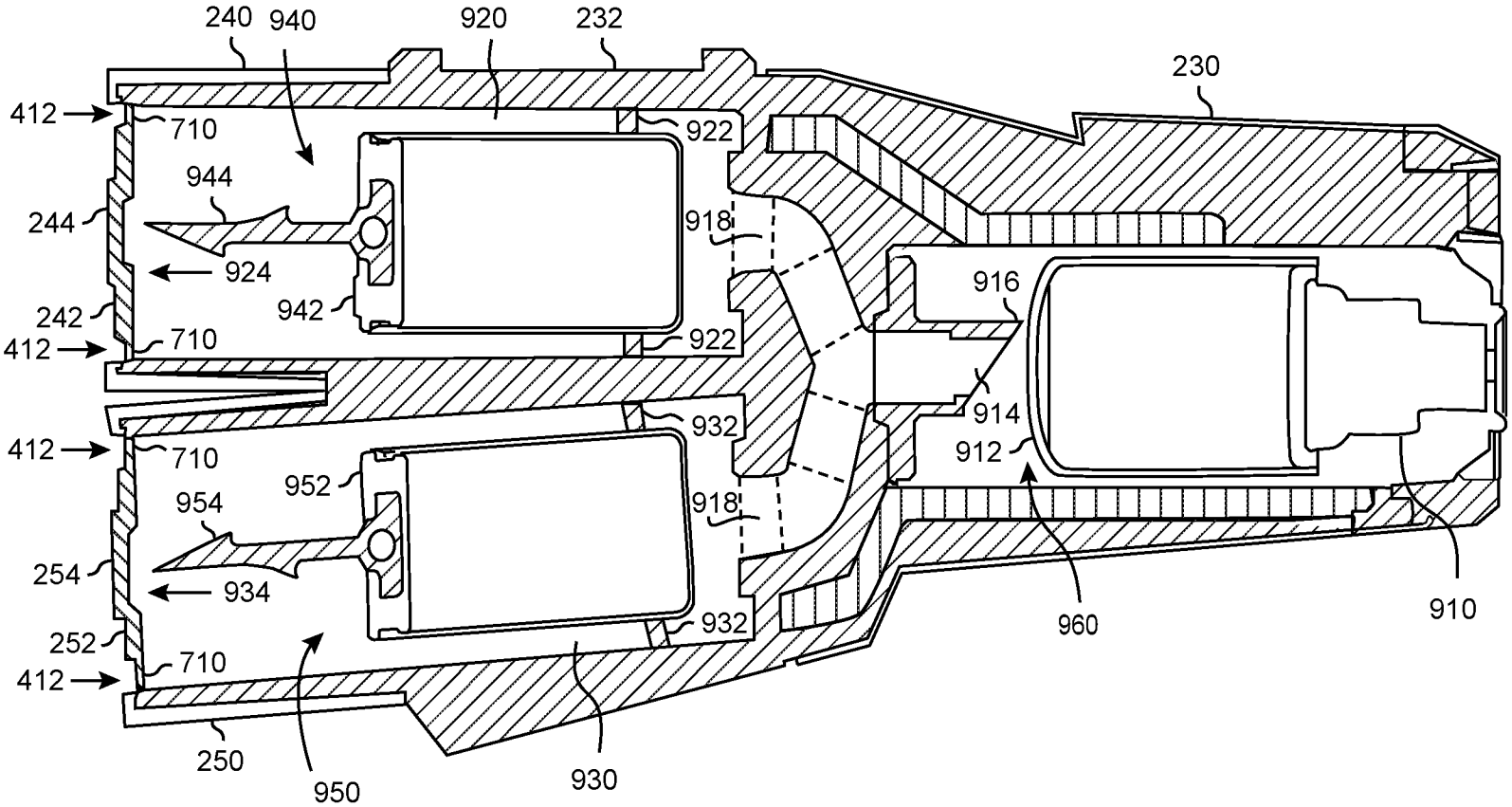
FIG. 9 is a cross-section view of the cartridge of FIG. 3 along 9-9.

A cross-section of cartridge 230 prior to launch is shown in FIG. 9, in accordance with various embodiments. Cartridge 230 includes a propulsion system 960, one or more bores 920 and 930, one or more caps 240 and 250, and one or more doors 242 and 252. Caps 240 and 250 may be coupled to an exterior of a housing 232 of cartridge 230. Doors 242 and 252 may be coupled to caps 240 and 250, respectively.

Propulsion system 960 performs the functions of a propulsion system described above. Propulsion system 960 may include one or more of a pyrotechnic 910, a canister 912, an anvil 916, and/or a manifold 918. In order to initiate the propulsion system, a launch generator (e.g., launch generator 134, with brief reference to FIG. 1) of handle 210 sends a signal to cartridge 230. The signal ignites pyrotechnic 910 thereby activating propulsion system 960. Igniting pyrotechnic 910 causes pyrotechnic 910 to provide a rapidly expanding gas. The force of the rapidly expanding gas from pyrotechnic 910 presses against canister 912 to move canister 912 toward anvil 916. Anvil 916 is sized and shaped to pierce canister 912. For example, anvil 916 may include a sharp and/or pointed edge for piercing canister 912. Canister 912 contains a compressed gas. After anvil 916 has pierced (e.g., punctured, ruptured) canister 912, the compressed gas exits canister 912 and expands rapidly. Anvil 916 includes a bore 914 (e.g., an anvil bore) which channels the expanding gas released by canister 912 through manifold 918 and into bores 920 and 930.

One or more detents, such as detents 922 and 932, may be positioned on an inner surface of bores 920 and 930, respectively. Detents 922 may include two or more detents. Detents 932 may include two or more detents. Detents 922 and 932 may be distributed around the interior of bores 920 and 930, respectively, in any manner. The size and positions of detents 922 and 932, shown in FIG. 9, are used for illustrative purposes only and is not a limitation. Bores 920 and 930 include openings 924 and 934 respectively, which prior to launch are closed (e.g., at least partially covered) by doors 242 and 252 respectively. Detents 922 and 932 retain electrodes 940 and 950 in their respective bores and positions prior to launch. Detents 922 and 932 retain electrodes 940 and 950, respectively, so that spears 944 and 954 do not contact doors 242 and 252, respectively.

Electrode 940 includes body 942 and spear 944. Similarly, electrode 950 includes body 952 and spear 954. Spears 944 and 954 are coupled to a forward portion of each body 942 and 952. Although not shown, a first filament and a second filament are positioned inside body 942 and 952 respectively. The first filament and the second filament may be coupled to electrode 940 and 950, respectively, and to cartridge 230 (e.g., a first end of each filament may be coupled to an electrode and a second end of each filament may be coupled to a same cartridge). The filaments are used to provide the stimulus signal from the handle of the CEW to electrodes 940 and 950 through the target.

Caps 240 and 250 may be coupled by interference to cartridge housing 232. Doors 242 and 252 couple to caps 240 and 250, respectively, in order to cover (e.g., seal) bore openings 924 and 934, respectively. Door 242 includes center portion 244, vents 412, and covers 710. Similarly, door 252 includes center portion 254, vents 412, and covers 710.

Prior to activation (e.g., initiation) of propulsion system 960, door 242 covers opening 924. Additionally, electrode 940 is retained in bore 920 a distance away from door 242 by detents 922. After propulsion system 960 is activated, a rapidly expanding gas enters bore 920. A portion (e.g., first portion) of the gas bypasses electrode 940 to apply a force on door 242. The force breaks covers 710 of vents 412. The portion of gas that bypassed electrode 940 exits bore 920 via vents 412. The remainder of the expanding gas (e.g., second portion) applies a force to body 942 of electrode 940. The force is of sufficient magnitude (e.g., strength) to detach (e.g., decouple) electrode 940 from detents 922 and launch (e.g., move, propel, push) electrode 940 toward door 242. As electrode 940 moves toward door 242, spear 944 pierces center portion 244. Spear 944 couples (e.g., attaches, retains) door 242 to electrode 940. Spear 944 may include barbs that aid in retaining door 242 attached to spear 944. As the force of the expanding gas continues to push electrode 940 forward, spear 944 pushes completely through center portion 244 of door 242. A forward portion of body 942 contacts door 242. The force of the gas presses body 942 against door 242 and applies a force on tabs 410. The force against tabs 410 increases until tabs 410 break. Breaking tabs 410 decouples door 242 from cap 240. However, even though door 242 is decoupled from cap 240, door 242 remains coupled to electrode 940 because of spear 944. As electrode 940 exits bore 920, door 242 remains coupled to the forward portion of electrode 940.

The launch of electrode 950, which includes breaking covers 710, piercing door 242, breaking tabs 410, and exiting bore 930 occurs in the same manner as electrode 940.

Figure 10:
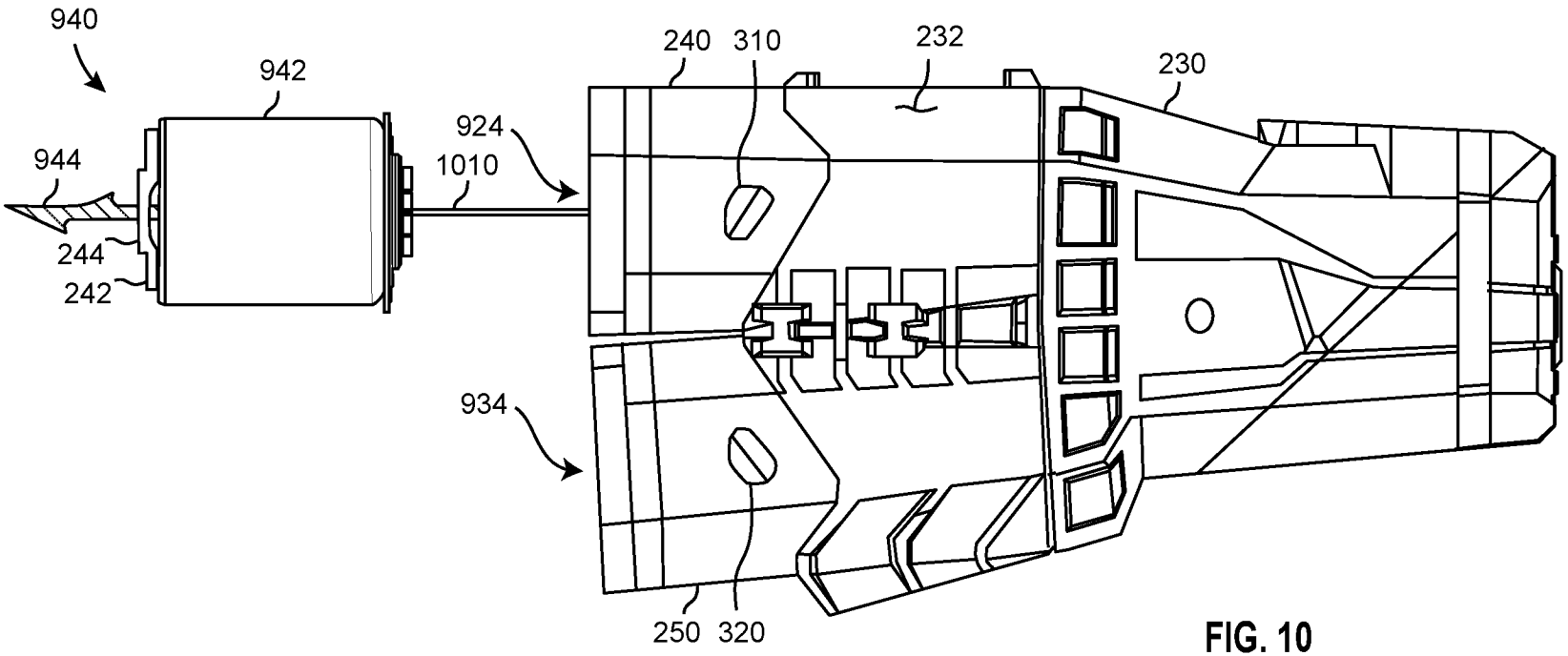
FIG. 10 is a side view of the cartridge of FIG. 3 launching an electrode.

Launched electrode 940, shown in FIG. 10, has exited bore 920 and flown a distance away from cartridge 230 toward a target. As electrode 940 flies through the air, filament 1010 deploys (e.g., unwinds) from body 942. Filament 1010 remains tethered (e.g., mechanically coupled) to electrode 940 and cartridge 230 before, during and after launch thereby electrically coupling the signal generator of CEW 200 to a target.

Center portion 244 of door 242 has been pierced by spear 944 during launch. Door 242 remains coupled to a forward portion of electrode 940 as it flies toward and impacts a target. Door 242 may be formed of a pliable (e.g., flexibility) material. The flexibility of door 242 may absorb some of the force of impact of electrode 940 with the target to reduce the force of impact of electrode 940 with the target, thereby reducing potential injury to the target. In this implementation, because center portion 244 is not in the same plane as main portion of door 242, door 242 may flex during impact with the target thereby potentially further decreasing the force of impact of electrode 940 with the target.

After electrode 940 has impacted and coupled to the target, the signal generator of CEW 200 may provide a stimulus signal through filament 1010 to the target.

Figure 11:
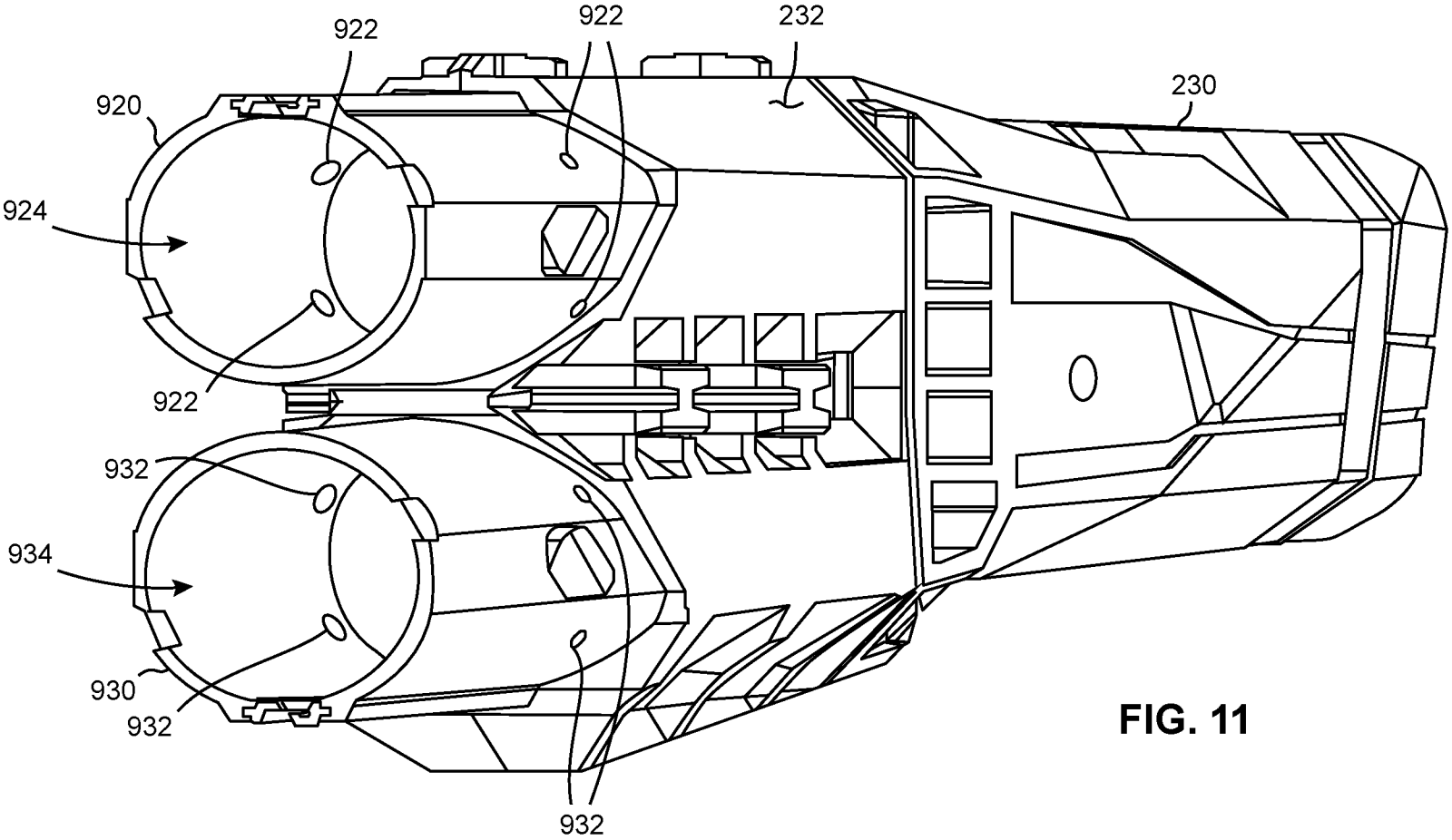
FIG. 11 is a perspective view of the cartridge of FIG. 3 showing two or more bores and detents.

FIG. 11 shows a possible implementation of detents, such as detents 922 and 932. In this implementation, detents 922 and 932 are distributed around the inside of bores 920 and 930 respectively. In this implementation, there are four detents 922 and four detents 932 evenly distributed around an inner surface of bores 920 and 930, respectively. An even distribution may improve the ability of detents 922 and 932 to hold and position electrodes 940 and 950 in their respective bores.

In various embodiments, a cartridge may comprise one or more detents having varying characteristics and dimensions. As previously discussed, a detent may be disposed within a bore of a cartridge. A bore of a cartridge may comprise any number of detents, such as one detent, two detents, three detents, four detents, etc. Each detent in a same bore may comprise a similar length such that an electrode in contact with each detent in the bay may be positioned along a central axis of the bore. In that regard, the one or more detents in a bay may be sized, shaped, and configured to center an electrode in the bore prior to launch of the electrode.

A detent may be coupled to an inner surface of a bore (e.g., a first end of the detent is coupled to an inner surface of the bore). A detent may be coupled to an inner surface of the bore proximate a rear of the bore. A detent may remain coupled to the inner surface of the bore before, during, and after launch of an electrode. In various embodiments, launch of the electrode may also decouple the detent from the inner surface of the bore. In that respect, the detent may be decoupled from both the electrode and the bore.

In various embodiments, a cartridge or cap may comprise one or more holes defining an opening through an outer surface of the cartridge or cap. The hole may be sized and shaped to receive a detent. For example, a detent may be inserted through the hole to couple the detent to the inner surface of the bore. The detent may remain coupled through the hole via interference, an adhesive, and/or any other suitable method.

In various embodiments, a detent may comprise a first end opposite a second end. The first end may be coupled to the inner surface of the bore. The second end may be coupled to the electrode. The detent may be coupled to the electrode using any suitable technique. For example, the detent may be coupled to the electrode by contacting the electrode. The detent may be coupled to the electrode by interference (e.g., the detent may be inserted into a groove of the electrode). The detent may be coupled to the electrode by an adhesive.

A detent may extend radially inward from the inner surface of the bore. A detent may extend at a right angle from the inner surface of the bore (e.g., perpendicularly disposed). A detent may extend radially inward at an axially inward angle (e.g., inward towards a manifold in the cartridge). A detent may extend radially inward at an axially outward angle (e.g., outward towards a manifold in the cartridge).

A detent may comprise any suitable size and shape. For example, a detent may comprise a protrusion having a rectangular shape (e.g., as depicted in FIG. 9), a triangular shape, a square shape, or any other suitable shape. In various embodiments, a detent may comprise a ring shape defining a radially-inward protrusion along a circumferential surface of the inner bore of the cartridge. The detent may comprise a full ring shape (e.g., a monolithic ring shape), a half ring shape, and/or any other partial ring shape.

In various embodiments, a detent comprising a full ring shape may comprise one or more vents (e.g., detent vents) configured to allow gas to pass through. The vents may be equidistant from each other to at least partially ensure equal passage of the gas. The vents may also comprise similar dimensions (e.g., size and shape) to at least partially ensure equal passage of the gas. In various embodiments, a cartridge may comprise a plurality of detents, with each detent forming a less than full ring shape. For example, in embodiments comprising four detents each of the four detents may comprise a quarter, or less, ring shape. In embodiments comprising two detents, each of the two detents may comprise a half, or less, ring shape.

In various embodiments, a detent may comprise a variable thickness. The variable thickness may include at least a first portion of the detent that has a different thickness than a second portion of the detent. For example, a first end of a detent may be coupled to an inner surface of a bore and a second send of the detent may be coupled to an electrode. For example, the first end may comprise a greater thickness than the second end. As a further example, the second end may comprise a lesser thickness than the first end. As a further example, a body of the detent may comprise a greater thickness than the second end, but a lesser thickness than the first end. A first end having a greater thickness may aid in the detent remaining coupled to the inner surface of the bore in response to the electrode being launched from the bore. A second end having a lesser thickness may aid in the detent decoupling from the electrode in response to the electrode being launched.

In various embodiments, a cartridge may comprise a plurality of detents. The plurality of detents may be distributed around an inner circumference of a bore of the cartridge. Each detent of the plurality of detents may be circumferentially separated by a distance. For example, in a cartridge having four detents a first detent and a second detent may be circumferentially separated by a first distance, the second detent and a third detent may be circumferentially separated by a second distance, the third detent and a fourth detent may be circumferentially separated by a third distance, and the fourth detent and the first detent may be circumferentially separated by a fourth distance.

In various embodiments, each detent of the plurality of detents may be equidistant (e.g., each distance between each of the detents comprises an equal distance). In various embodiments, two or more detents of the plurality of detents may be separated by a distance that is not equidistant with at least a second distance separating two or more detents.

In various embodiments, a cartridge may comprise one or more detent sections disposed within a same bore in the cartridge. Each detent section may comprise one or more detents. The one or more detents in a detent section may each be coplanar, or generally coplanar, with each other. Each detent section may be at least partially axially displaced from each other (e.g., a first detent section is axially displaced from a second detent section). For example, a cartridge may comprise only a first detent section (e.g., as depicted in FIG. 9). The first detent section may be positioned in a forward location in the inner bore, proximate a front end of an electrode; a middle location in the inner bore, proximate a mid-section of the electrode; or a rearward location in the inner bore, proximate a rear end of the electrode. As a further example, a cartridge may comprise a first detent section and a second detent section. The first detent section may be positioned in a forward location in the inner bore, proximate a front end of an electrode. The second detent section may be positioned in a rearward location in the inner bore, proximate a rear end of the electrode.

Figure 12:
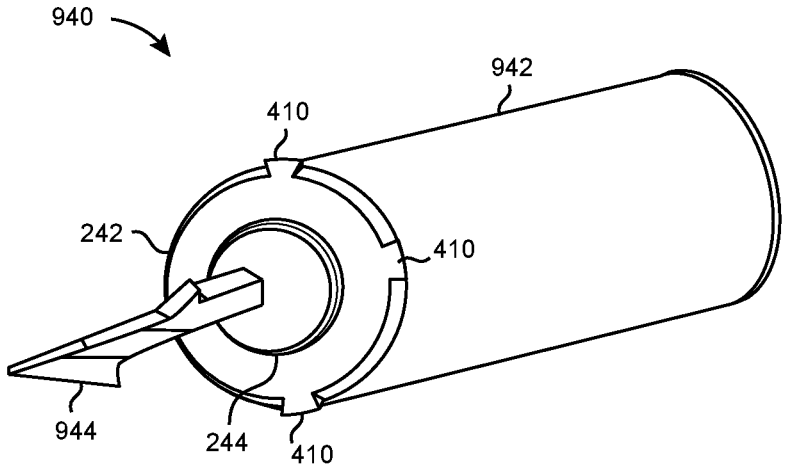
FIG. 12 is a perspective view of an electrode after launch from the cartridge of FIG. 3.

A perspective view of a launched electrode is shown in FIG. 12. Center portion 244 is pierced by spear 944 to couple door 242 to electrode 940. Tabs 410 are decoupled from cap 240. Tabs 410 extend beyond body 942 electrode 940. The extension of tabs 410 beyond body 942 provides some cushioning when electrode 940 strikes the target at an angle. The outer edge of the circumference of door 242 may also extend beyond the outer edge of body 942 to provide additional cushioning when electrode 940 strikes a target at an angle. Electrode 940 performs the functions of an electrode as described above.

Door 242 may include structures that improve the flight characteristics of electrode 940. Door 242 may include structures or altering a shape of the forward portion of body 942 improve the flight characteristics of electrode 940. Door 242 may include control services for interacting with air to improve the flight characteristics and/or accuracy of flight of electrode 940. For example, tabs 410 may be shaped to perform the functions of a fin to improve flight. Door 242 may alter the center of pressure with respect to the center of mass of electrode 940 improve flight. For example, door 242 may be shaped to force the center of pressure on electrode 940 to be positioned behind the center of mass electrode 940 to improve flight stability.

Retaining door 242 coupled to electrode 940 during flight may also improve the flight characteristics of electrode 940. The weight and or position of door 242 on electrode 940 may increase the drag of electrode 940 through air. Increasing the drag experiences on an electrode during flight may increase stability of flight. Increasing the stability of flight may increase the accuracy of flight. Increasing the accuracy of flight may result in more accurate placement of electrodes with respect to the target. Increased accuracy of flight may improve correlating the location of impact of an electrode with a laser that predicts (e.g., indicates) the location of impact. Further, increasing the accuracy of flight may improve the repeatability of accuracy between electrodes and cartridges manufactured at different times and/or in different lots in the manufacturing process.

The aerodynamic characteristics of door 242 may cooperate with the drag applied on electrode 940 by filament 1010 to improve the accuracy and/or repeatability of flight.

In various embodiments, a cartridge for coupling to a handle of a conducted electrical weapon is disclosed. The cartridge may comprise: a housing, the housing includes a bore having an opening toward a forward portion of the housing; an electrode, the electrode includes a spear and a body, the spear coupled to a forward portion of the body, the electrode for launching toward a human or animal target for providing a stimulus signal through the target to impede locomotion of the target; a propulsion system for launching the electrode toward the target, the propulsion system positioned in the housing; and a door, the door covers the opening, the door includes a center portion, two or more frangible tabs, and two or more vents, each vent sealed by a frangible cover. Prior to activating the propulsion system to launch the electrode: the two or more tabs are coupled to the housing whereby the door seals the opening; and the electrode is positioned in the bore. After activating the propulsion system: a rapidly expanding gas enters the bore; a first portion of the gas applies a first force on the covers of the two or more vents, the first force breaks the covers, whereby a first portion of the gas exits the bore via the vents; and a second portion of the gas applies a second force on the body of the electrode whereby the electrode moves forward in the bore toward the opening. As the electrode moves forward in the bore: the spear pierces the center portion of the door thereby coupling the door to the electrode; and the body contacts the door and applies a third force to the door, the third force breaks the two or more tabs to decouple the door from the housing, the door remains in contact with the body and pierced by the spear as the electrode exits the bore and flies toward the target.

In various embodiments, the door contacts a forward portion of the electrode. In various embodiments, the center portion of the door has a first thickness; the two or more tabs have a second thickness; the two or more covers have a third thickness; and the first thickness is greater than the second thickness and the third thickness. In various embodiments, the first force is less than the third force. In various embodiments, the two or more tabs have a first thickness; the two or more covers have a second thickness; and the second thickness is less than the first thickness. In various embodiments, the two or more tabs are positioned on an outer periphery of the door. The two or more tabs may be positioned equidistant with respect to one another. The two or more tabs may be evenly distributed around a periphery of the door. In various embodiments, the door remains in contact with the body as the electrode impacts the target; and the door decreases a force of impact of the electrode on the target.

In various embodiments, a cartridge for coupling to a handle of a conducted electrical weapon is disclosed. The cartridge may comprise: a housing, the housing includes a bore having an opening at a forward portion of the housing, the bore includes two or more detents on an inner surface of the bore; an electrode having a spear and a body, the electrode positioned in the bore, the electrode for launching toward a human or animal target for providing a stimulus signal through the target to impede locomotion of the target; a propulsion system for launching the electrode toward the target; and a door, at least a portion of a circumference of the door couples to the housing to couple the door to the housing and over the opening. The propulsion system provides a force that: decouples the electrode from the detents; and moves the electrode forward toward the door. As the electrode moves forward in the bore: the spear pierces the door thereby coupling the door to the electrode; and the body contacts the door and decouples the circumference of the door from the housing. The door remains in contact with the body and pierced by the spear as the electrode exits the bore and flies toward the target.

In various embodiments, prior to activating the propulsion system, the two or more detents retain the electrode rearward of the door. In various embodiments, the door remains in contact with the body as the electrode impacts the target; and the door decreases a force of impact of the electrode on the target.

The foregoing description discusses implementations (e.g., embodiments), which may be changed or modified without departing from the scope of the present disclosure as defined in the claims. Examples listed in parentheses may be used in the alternative or in any practical combination. As used in the specification and claims, the words "comprising," "comprises," "including," "includes," "having," and "has" introduce an open-ended statement of component structures and/or functions. In the specification and claims, the words "a" and "an" are used as indefinite articles meaning "one or more." While for the sake of clarity of description, several specific embodiments have been described, the scope of the invention is intended to be measured by the claims as set forth below. In the claims, the term "provided" is used to definitively identify an object that not a claimed element but an object that performs the function of a workpiece. For example, in the claim "an apparatus for aiming a provided barrel, the apparatus comprising: a housing, the barrel positioned in the housing," the barrel is not a claimed element of the apparatus, but an object that cooperates with the "housing" of the "apparatus" by being positioned in the "housing".

The location indicators "herein," "hereunder," "above," "below," or other word that refer to a location, whether specific or general, in the specification shall be construed to refer to any location in the specification whether the location is before or after the location indicator.

Methods described herein are illustrative examples, and as such are not intended to require or imply that any particular process of any embodiment be performed in the order presented. Words such as "thereafter," "then," "next," etc. are not intended to limit the order of the processes, and these words are instead used to guide the reader through the description of the methods.

What is claimed is:

1. A cartridge for a conducted electrical weapon, comprising:

a bore defining an opening in the cartridge;

an electrode disposed within the bore, wherein the electrode comprises a body having a forward portion and a rearward portion; and a detent extending inward from an inner surface of the bore between the forward portion and the rearward portion of the body of the electrode, wherein the detent is configured to couple to the electrode prior to a launch of the electrode, wherein the launch of the electrode causes forward movement of the electrode, and wherein the forward movement of the electrode is configured to decouple the electrode from the detent.

2. The cartridge of claim 1, wherein the detent comprises a plurality of detents distributed around an inner circumference of the bore.

3. The cartridge of claim 2, wherein the plurality of detents each comprise a same length.

4. The cartridge of claim 2, wherein each detent of the plurality of detents are separated by an equal distance.

5. The cartridge of claim 2, wherein all detents of the plurality of detents are coplanar.

6. The cartridge of claim 1, wherein the detent extends from the inner surface of the bore at a right angle.

7. The cartridge of claim 1, wherein the detent extends from the inner surface of the bore at an axially inward angle or an axially outward angle.

8. The cartridge of claim 1, wherein the detent comprises a ring shape.

9. The cartridge of claim 1, wherein the detent couples to the electrode by contacting the electrode.

10. The cartridge of claim 1, wherein the detent couples to the electrode by at least one of interference and an adhesive.

11. A conducted electrical weapon, comprising:

a handle defining a bay; and a cartridge inserted within the bay, the cartridge comprising:

an electrode, the electrode for launching toward a target to provide a stimulus signal through the target to impede locomotion of the target, the electrode comprising a body having a forward portion and a rearward portion;

a bore having an opening, the opening oriented toward a forward direction;

two or more detents positioned on an inner surface of the bore between the forward portion and the rearward portion of the body of the electrode; and a propulsion system for providing a rapidly expanding gas to launch the electrode toward the target, wherein:

prior to the propulsion system providing the rapidly expanding gas to launch the electrode, the two or more detents contact the body of the electrode to retain the electrode in the bore; and after the propulsion system provides the rapidly expanding gas to launch the electrode, the rapidly expanding gas applies a force on the electrode that decouples the body of the electrode from the detents.

12. The conducted electrical weapon of claim 11, wherein the two or more detents are distributed around an inner circumference of the bore.

13. The conducted electrical weapon of claim 11, wherein the force applied by the rapidly expanding gas is greater than a retaining force applied by the two or more detents on the electrode to retain the electrode prior to the propulsion system providing the rapidly expanding gas.

14. The conducted electrical weapon of claim 11, wherein prior to the propulsion system providing the rapidly expanding gas, the two or more detents retain the electrode rearward of a cover that covers the opening of the bore.

15. The conducted electrical weapon of claim 14, wherein the propulsion system provides the rapidly expanding gas to launch the electrode, a forward portion of the electrode contacts the cover to detach the cover from the opening.

16. A cartridge for a conducted electrical weapon:

a bore defining an opening;

a projectile disposed within the bore; and a first detent section comprising a plurality of detents extending from an inner surface of the bore proximate a rear end of the projectile, wherein the first detent section is configured to retain the projectile along a central axis of the bore prior to a launch of the projectile, and wherein a portion of the first detent section is configured to remain within the bore after the launch of the projectile.

17. The cartridge of claim 16, further comprising a second detent section, wherein the second detent section comprises a second plurality of detents extending from the inner surface of the bore proximate a forward end of the projectile.

18. The cartridge of claim 16, wherein a detent of the plurality of detents comprises a variable thickness.

19. The cartridge of claim 16, wherein a detent of the plurality of detents comprises a first end coupled to the inner surface of the bore and a second end coupled to the projectile.

20. The cartridge of claim 19, wherein the first end of the detent comprises a greater thickness than the second end of the detent.

* * * * *